United States Patent [19]

Olson

[11] Patent Number: 4,890,853

[45] Date of Patent: Jan. 2, 1990

[54] WHEELCHAIR WALKER

[76] Inventor: Luanne Olson, 6005 W. Roscoe, Chicago, Ill. 60634

[21] Appl. No.: 165,177

[22] Filed: Mar. 7, 1988

[51] Int. Cl.[4] ..... A47C 7/50

[52] U.S. Cl. ..... 280/87.021; 5/81 R; 272/70.3; 280/47.4; 297/5; 297/DIG. 4

[58] Field of Search ..... 297/DIG. 4, DIG. 10, 297/5; 5/81 R; 272/70.3, 70.4; 280/87.02 R, 47.25, 47.38, 47.4, 47.41, 87.021, 87.01, 87.051

[56] References Cited

U.S. PATENT DOCUMENTS

| | | | |
|---|---|---|---|
| D. 247,458 | 3/1978 | Johansson | D24/64 |
| 1,361,102 | 12/1920 | Scott | 297/DIG. 4 X |
| 1,448,783 | 3/1923 | Blewitt et al. | 297/6 |
| 1,917,440 | 7/1933 | Finkbeiner et al. | 297/6 |
| 2,327,671 | 9/1943 | Rupprecht | 272/70.3 |
| 2,339,007 | 1/1944 | Gahm | 297/5 |
| 2,437,778 | 3/1948 | Ames | 297/DIG. 4 X |
| 2,654,416 | 10/1953 | Maniscalco | 297/DIG. 4 X |
| 2,792,052 | 5/1957 | Johannesen | 297/DIG. 4 X |
| 2,798,533 | 7/1957 | Frank | 297/6 |
| 3,354,893 | 11/1967 | Schmerl | 135/67 |
| 3,397,883 | 9/1968 | Kiehn | 272/70.3 |
| 3,490,808 | 1/1970 | Siegel | 297/153 |
| 3,654,643 | 4/1972 | Clanan | 5/81 B |
| 3,778,052 | 12/1973 | Andow et al. | 272/70.4 |
| 3,788,695 | 1/1974 | Salem | 297/DIG. 4 X |
| 3,790,974 | 2/1974 | Johansson | 5/86 |
| 3,940,808 | 3/1976 | Petrini | 5/81 R X |
| 4,010,499 | 3/1977 | Davis et al. | 297/417 X |
| 4,187,869 | 2/1980 | Marchetti | 135/67 |
| 4,399,572 | 9/1983 | Johansson | 5/81 R |
| 4,415,198 | 11/1983 | Brearley | 297/6 |
| 4,477,117 | 10/1984 | Higgs | 297/DIG. 4 X |
| 4,487,019 | 12/1984 | Johansson | 60/481 |
| 4,527,829 | 7/1985 | Fanslau et al. | 297/DIG. 4 X |

OTHER PUBLICATIONS

The Ambulator® Promotional Sheet by American Ambulator Company, Inc.

Arjo Lift Hygiene Chair Brochure by Arjo Hospital Equipment.

Arjo Patient Transfer Systems by Arjo Hospital Equipment, Inc.

Arjo Lift Walker Promotional Sheet by Arjo Hospital Equipment, Inc.

*Primary Examiner*—Charles A. Marmor
*Assistant Examiner*—Michael Mar
*Attorney, Agent, or Firm*—Wallenstein, Wagner & Hattis, Ltd.

[57] ABSTRACT

A foot-propelled wheelchair-walker device which provides for the seated support of the user and also enables the user to stand and walk with the assistance of the device. The wheelchair-walker device has a four wheel base, a hydraulic post for height adjustment, a bent U-shaped cloth covered frame for a patient seat support suspended from the hydraulic post, a retaining bar attachable to said frame and a strap that extends between the user's legs and attaches to the retaining bar to secure the position of the user.

13 Claims, 3 Drawing Sheets

WHEELCHAIR WALKER

DESCRIPTION

1. Technical Field

The present invention generally relates to adult wheelchairs and walker devices, and in particular to an easily accessible wheelchair-walker that facilitates proper anatomical posture and provides for seated as well as standing use.

2. Background of the Invention

This invention relates generally to devices which assist the mobility of persons such as the elderly and disabled, who are unable to walk or move around without assistance. Specifically, the invention relates to a foot propelled wheelchair-walker device.

Persons who are unable to transport themselves without assistance are frequently required to rely on traditional devices such as wheelchairs and adult walkers in order to facilitate their mobility. Due to economic constraints, patient care facilities often possess a limited personnel staff. Staff members are not available to provide constant assistance to each patient throughout the day. Frequently, these conditions result in patients being situated in a wheelchair for the duration of each day. Disabled individuals residing in private homes also encounter the same experience. Persons who have limited walking ability are similarly restricted since they oftentimes require assistance from others in order to reach their walker device or require supervision in their use of the device. The present invention provides such persons with the ability to transport themselves in a safe manner with little assistance or supervision by others.

Unlike expensive motorized wheelchairs, most wheelchairs require the user manually to propel and direct the movement of the chair with their arms. However, many persons find it less strenuous to propel wheelchairs with their feet. Foot propulsion also aids the wheelchair users in directing the movement of the chair. For example, the user simply extends his/her leg forward and fixes one or both feet on the ground while simultaneously pulling their wheelchair toward their feet with their leg(s). This maneuvering is continued using one or both feet until the user reaches the desired destination. By placing the feet in the desired direction and employing the movement described above, the user is able to steer the direction of the wheelchair. Conversely, upper extremity propulsion requires the user to push the wheel that is opposite of the desired direction. This type of propulsion is more difficult to execute because it requires the user to overcome the natural inclination to use the side which is in the desired direction.

Prolonged periods of sitting in a wheelchair cause physical problems for the user. For instance, when the user's legs are maintained in a bent position supported by footrests which are attached to the wheelchair, undesirable anatomical positions are assumed. The continuous bent positioning of the user's legs in a seated position contribute to the formation of hip and knee flexion contractures. Skin ulcers often surface once such contractures develop. The decreased activity of the user's lower extremities impairs circulation to the extremities frequently leading to the formation of skin ulcers. Additionally, restricted use of the lower extremities can cause or aggravate constipation problems.

Use of the lower extremities in the propulsion of the wheelchair, while aiding execution of movement of the chair, does not provide a solution to the problems encountered when the chair is propelled by the upper extremities as discussed above. During the time that the wheelchair is being propelled by the user's feet, the user's hip joint remains flexed at 90 degrees. Similarly, the user's knee joint is initially flexed at 90 degrees in the idle position, and is subsequently contracted and extended in a range from approximately 40 degrees to 120 degrees during foot propulsion. Due to the limited extension of the lower extremities in foot propulsion of the wheelchair, normal anatomical posture is not maintained leading to improper circulation, and development of contractures and skin ulcers in the lower extremities. The lack of periodic changes in the wheelchair user's posture often contributes to postural hypotension.

The lack of weight-bearing pressure on the user's posture as a result of his/her confinement to a wheelchair may enhance the progression of osteoporosis in areas such as the lower extremities and back, and can cause degenerative joint changes in the ankle, knee and hip joints.

Persons who require a walker or other support device to assist them in ambulation similarly encounter problems with their use of such devices. Often, such persons need the aid of another person to assist in their use of ambulation aids, such as walkers and similar devices. If the assisting person is not available, as may be the situation in a nursing home or other extended care facility where the number of patients or residents far exceeds the number of health care personnel, the impatient user may forego assistance and risk use of the walker by themselves or more seriously, attempt to walk without assistance of any kind. The threat of serious injury resulting from a fall for such persons is drastically increased. The present invention would provide the disabled person with the ability to transport him/herself safely whenever he or she desired.

Persons requiring the assistance of a walker for ambulation are dependent upon the walker for bodily support. At least one hand of such persons must always grasp the walker in order to provide adequate support. Thus, persons in walkers find it difficult if not impossible to perform daily activities such as washing dishes, light cleaning, cooking and other household chores, which require the use of both hands.

Adult walker devices ranging from the four-legged adult walker, to other more complicated devices have long aided ambulation. Two such devices are disclosed in U.S. Patent Nos. 2,792,052 and 3,778,052. In the invalid walker and transfer devices shown in these patents, the user is supported by underarm supports when standing or walking. The framework of each device extends in front of the user and accordingly, prevents the user from closely approaching countertops, furniture or other surfaces or objects that the user desires to access. Such devices are intended to assist in walking or in lifting the user and do not provide a support structure for the prolonged use of the device in either a standing or a sitting position. While the devices shown may be adjusted to accommodate the height of the user, adjustments cannot be made by the user. These prior known devices fail to accommodate the user for prolonged periods of time while maintaining the user in proper anatomical positions during use. Likewise, fixed frame devices having seats, such as those shown in U.S. Pat. Nos. 1,361,102 and 2,437,778, merely provide for use in a sitting position and do not allow the user to use the device as a walking aid. The known devices do not always provide for mobility and varied utility, and not all are capable of receiving a tray for eating or other activities for which a surface is required.

Hence, prior to the present invention, a need existed for an ambulation aid which provides for seated and standing use to facilitate correct anatomical posture. Further, a need existed for a ambulation aid designed for easy access and mobility by the user.

SUMMARY OF THE INVENTION

According to the present invention, a unique wheelchair-walker device for use by aged or otherwise disabled persons has been developed that avoids the problems of incorrect anatomical posture, development of contractures and ulcers resulting from poor circulation and prolonged pressure, and impeded mobility. A suspended seat in the present device accommodates the user in a sitting position and can be adjusted in height to support the user walking in a standing position. The seat is supported by a vertical standard that is connected to a U-shaped wheeled base. This construction enables the user to propel the wheelchair-walker device with his/her feet thereby providing for user mobility in a seated as well as a standing position. Finally, the novel design of the present invention allows for use of the invention in connection with a removable tray for eating and other user activities.

Generally, the preferred embodiment of the present invention includes a wheeled U-shaped base. The user is situated in the device so that his/her body faces the opening in the "U." This opening provides for unimpeded access to the suspended seat by the user and avoids interference with the user's foot movement during use. The base is equipped with footrests to support the lower extremities when the user is in a seated position. Placement of the user's feet on the footrests also helps to ensure that the user's feet will not obstruct the movement of the device when it is being pushed by another person. The footrests may be moved to the side so as not to interfere with the user's forward foot movement during self-propulsion of the device.

The suspended seat is supported by a vertical post or standard that is connected to the base opposite of the base opening. The standard adjusts in height so as to raise and lower the seat, thereby enabling the user to sit or to stand while supported by the device. The present invention contemplates use of a hydraulic system to raise and lower the height of the standard resulting in the corresponding vertical movement of the seat. Height adjustment can be accomplished before the user enters the device or while the user is situated in the device. The hydraulic lift can be activated by pumping a handle located on the backside of the standard. A valve located near the top of the standard regulates the pressure of the hydraulic fluid so that the seat can be adjusted and maintained at the desired height. The user may also adjust the height of the device by pumping a foot pedal located on the base of the device with his/her foot. This foot pedal may be inactivated if it is desirable to restrict the user from having access to the adjustment device as would be the case when a confused person is placed in the device.

The seat consists of a bent U-shaped frame covered with a sling made of non-rigid material or fabric that hangs from the seat frame and forms a chair. The seat material facilitates use of the device as a walker because it yields to the leg movement of the user. The bent U-shaped seat frame possesses two parallel horizontal arms to support the user's upper extremities. A retaining bar is secured to one of the arms of the bent U-shaped frame such as by a hinge and attaches to the other arm of the frame so as to enclose the user in the device and restrain the user from exiting the device.

A contiguous piece of the sling material forms a strap intended to extend between the legs of he user. The strap extends from the bottom front side of the sling and is attached to the retaining bar once the user has entered the seat. The combination of the strap and the retaining bar help to secure the user in the device and prevent the user from accidentally slipping out of the device.

When the seat is in the lower position, it accommodates the user in a sitting position and allows for the user's knee joints to be flexed in 90 degree angles. By raising the level of the seat, the user's knee joints are extended allowing for full extension of the user's legs.

By adjusting the seat to the appropriate height, the user's feet are placed in contact with the floor. The user is able to propel the device in an erect walking position or in a seated position by extending one foot forward and planting said foot in the desired direction while simultaneously pulling the device and him/herself. This process is repeated using one or both feet until the destination is reached. The user can also propel the device in a backward direction by reversing the foregoing process. If a user tires suddenly or becomes confused when walking in the device, there is no danger of the user falling. The user can simply rest his/her weight on the seat which is underneath him/her at all times providing full support at all times. Moreover, the seat can then be lowered by the user and the user may resume use of the device in a seated position. Similarly, the danger of tripping which is present when other walking aids are used is also eliminated because the seat structure supports and restrains the user and prevents the user from falling.

The arms of the seat frame are also capable of receiving a tray so that the user can sit in the device and eat meals or otherwise use the tray as a table, work or other surface. The addition of the tray to the present invention also provides increased assistance to stroke victims. Frequently, the shoulder joints of such patients become subluxed. Because the patient is unable to provide the internal support necessary to keep the joint in the proper alignment, gravity causes separation of this joint. The introduction of a tray to the present device provides support for the user's arms and helps to maintain the proper anatomical alignment of the shoulder joint.

Tray devices such as those that are known in the art and attach to tubular arms via snap on "C" clamps or those disclosed in U.S. Pat. No. 3,490,808, may be utilized with the subject device. The tray is removable and does not adversely affect the utility or mobility of the device. When it is desired that the device be stationary such as when the user is eating or doing other table top activities, the wheels of the base may be locked to prevent inadvertent movement of the device.

The present invention will be more completely described in the following detailed description of preferred embodiment and the claims appended thereto. Other advantages and aspects of the invention will become apparent upon making reference to the specification, claims, and drawings to follow.

DETAILED DESCRIPTION

Figure 2:
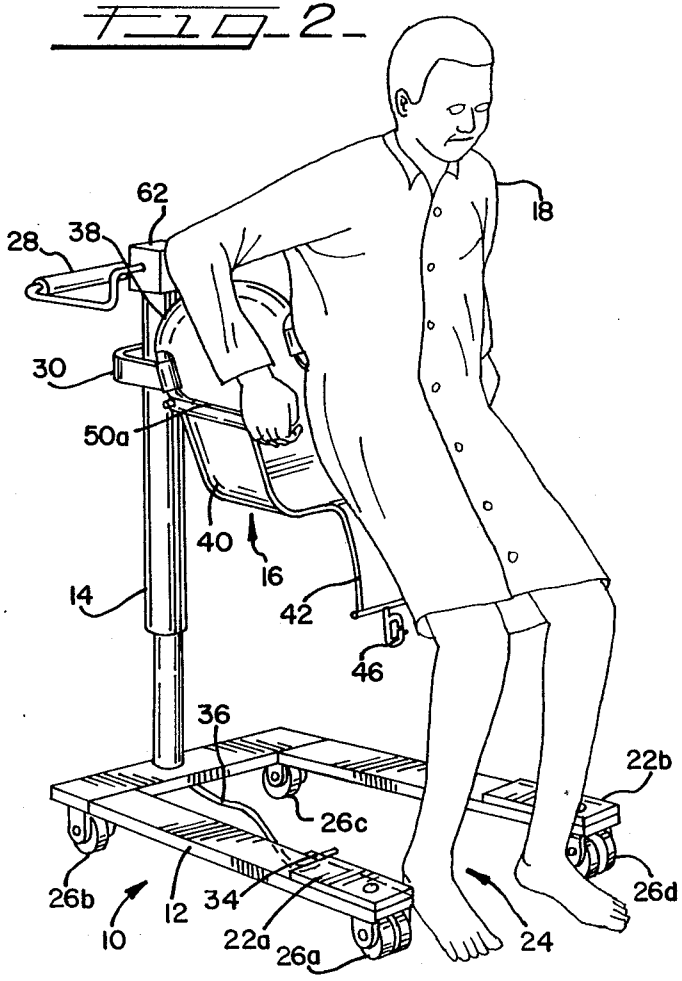
FIG. 2 is a perspective view of the preferred embodiment of the present invention showing the user entering or exiting the device.

While this invention is susceptible of embodiment in many different forms, there is shown in the drawings and will herein be described in detail a preferred embodiment of the invention.

Figure 1:
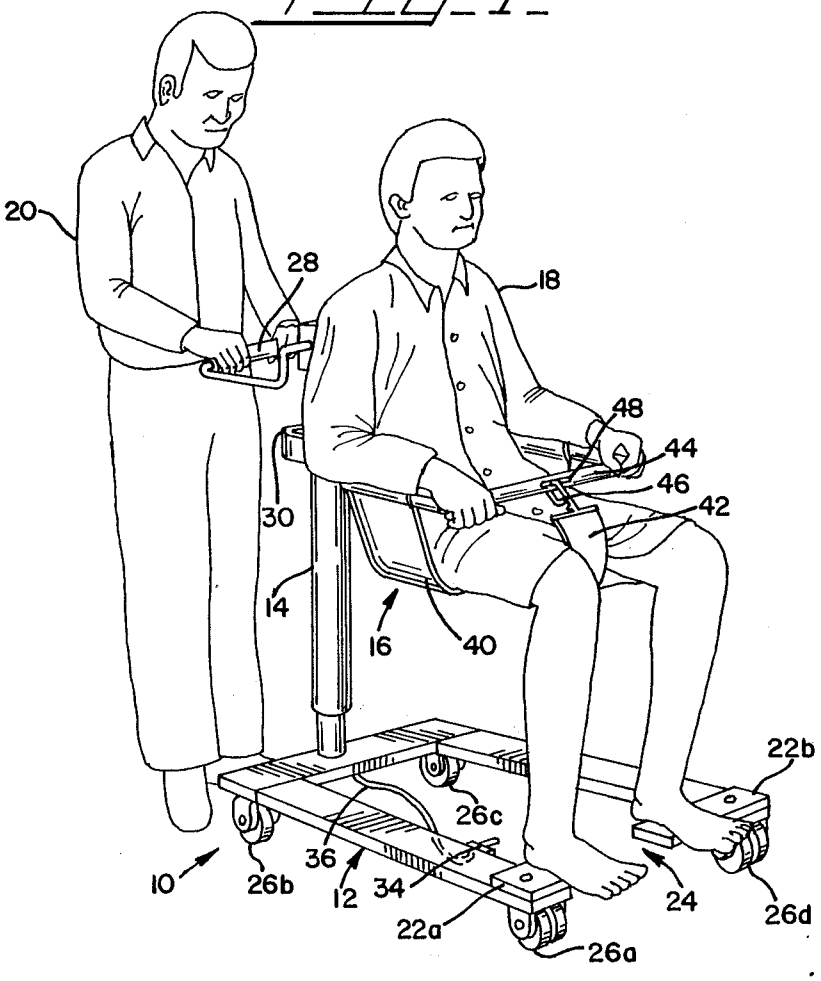
FIG. 1 is a perspective view of the preferred embodiment of the wheelchair-walker of the present invention showing the user in a seated position.

FIG. 1 discloses a preferred embodiment of the wheelchair-walker of the present invention generally referenced by 10. Wheelchair-walker 10 comprises a U-shaped base 12, vertical standard 14 attached to the base 12 and a suspended chair generally referenced by 16. The user 18 is shown in a seated position. An assistant 20 is shown in a position to adjust the height of the suspended chair 16. The user's 18 feet are supported by footrests 22*a* and 22*b* causing the user's knee joint to be flexed at a 90 degree angle.

In FIG. 2, user 18 adopts a slightly crouched position for entering or exiting said device 10 whether assisted into the device 10 by assistant 20 or without assistance. In order to enter or exit the device 10, the user 18 approaches or departs the device 10 through the base opening 24 and grabs the horizontal arms 50*a*, 50*b* of the chair subsequently lowering or raising his/her body 18 into or out of the chair 16. Some users 18 may require assistance in entering or exiting said device 10. However, even in the event that assistance is required, the same entry and exit positions will be assumed by the user 18.

Figure 3:
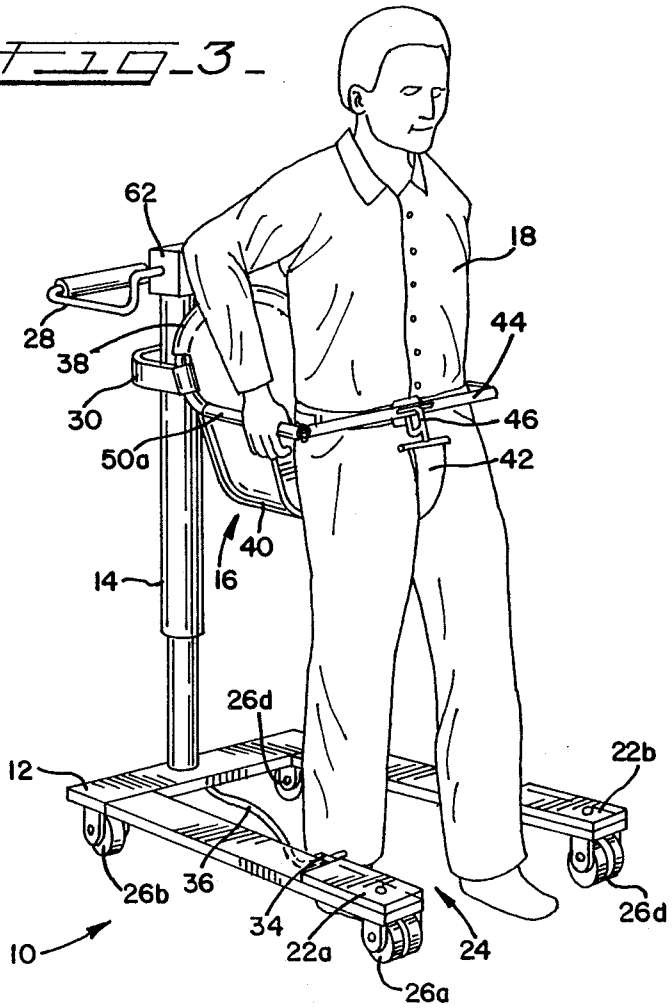
FIG. 3 is a perspective view of the preferred embodiment of the present invention showing the user in a standing position.

FIG. 3 shows user 18 standing in an erect position utilizing the device 10 to assist in walking. The base opening 24 provides for the unimpeded forward foot movement of the user when walking. User 18 is able to use device 10 to walk without the assistance of assistant 20. The chair 16 is underneath the user 18 and will prevent the user from falling during use of the device 10.

Figure 4:
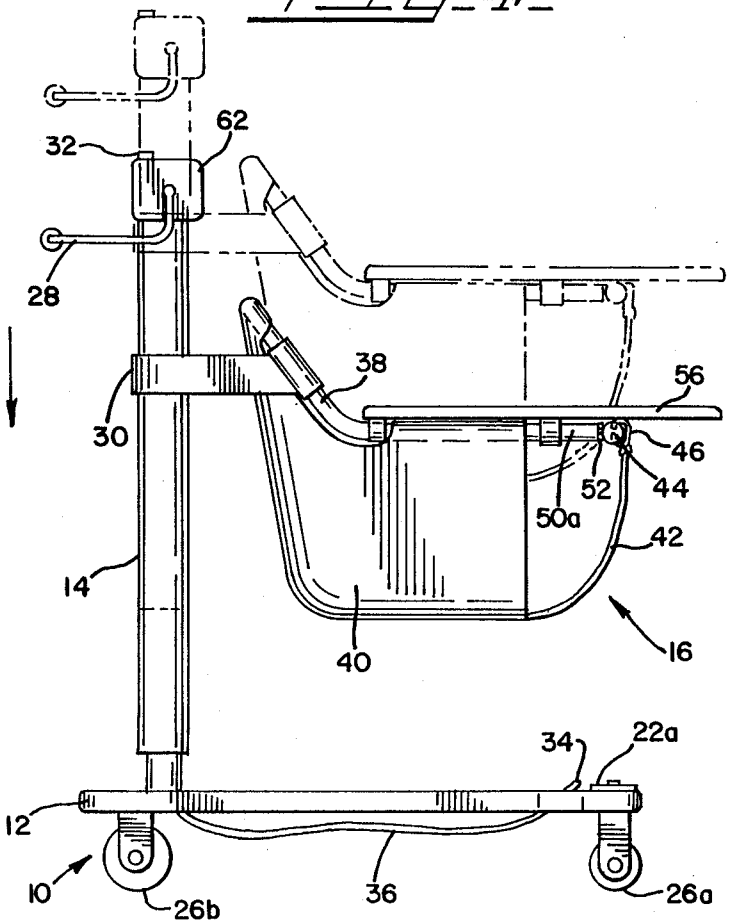
FIG. 4 is a side elevational view of the preferred embodiment of the present invention showing the adjustable height of the seat.

As further disclosed in FIG. 4, the vertical standard 14 is perpendicularly attached to the base 12 opposite of base opening 24. Base 12 has wheels 26*a*–26*b*, (FIGS. 1,2 and 3 showing all four wheels 26*a*–26*d*), to provide for the mobility of the device 10. If it is desired to keep the device stationary such as when the user 18 is eating, wheel locks (not shown) may be engaged to prevent the wheels 26*a*–*d* and the device 10 from moving. The suspended chair 16 is connected to said standard 14 by U-shaped beam 30 which is cantilevered from said standard 14. The opening 58 in said U-shaped beam 30 faces in the same direction as the base opening 24.

Said standard 14 is adjustable in height as shown by the arrow and dotted lines depicted in FIG. 4. Assistant 20 can adjust the height of the chair 16 by pumping handle pump 28 which activates the hydraulic lift mechanism of standard 14. A foot pedal pump 34 can also be pumped by the user's 18 foot to adjust the height of the chair 16. If it is undesirable for the user 18 to have access to the foot pedal pump 34, the foot pedal pump 34 may be deactivated so that the user 18 is unable to adjust the height of the chair 16. Valve 32 located on standard 14 regulates the pressure of the hydraulic fluid between the handle pump 28, the foot pedal pump 34 and the driven part 62. While height adjustment may be accomplished by various mechanisms, the present invention contemplates use of a hydraulic means for ease of height adjustment. A hose 36 connects the foot pedal pump 34 to the hydraulic means thereby facilitating adjustment of the chair 16 height by the user's foot.

By grasping the wheelchair-walker device 10 at handle pump 28 and pushing the device with the user 18 seated therein, the device 10 can also be used to transport disabled persons whether or not they are able to use their feet to propel the device. This situation is best shown in FIG. 1.

Figure 5:
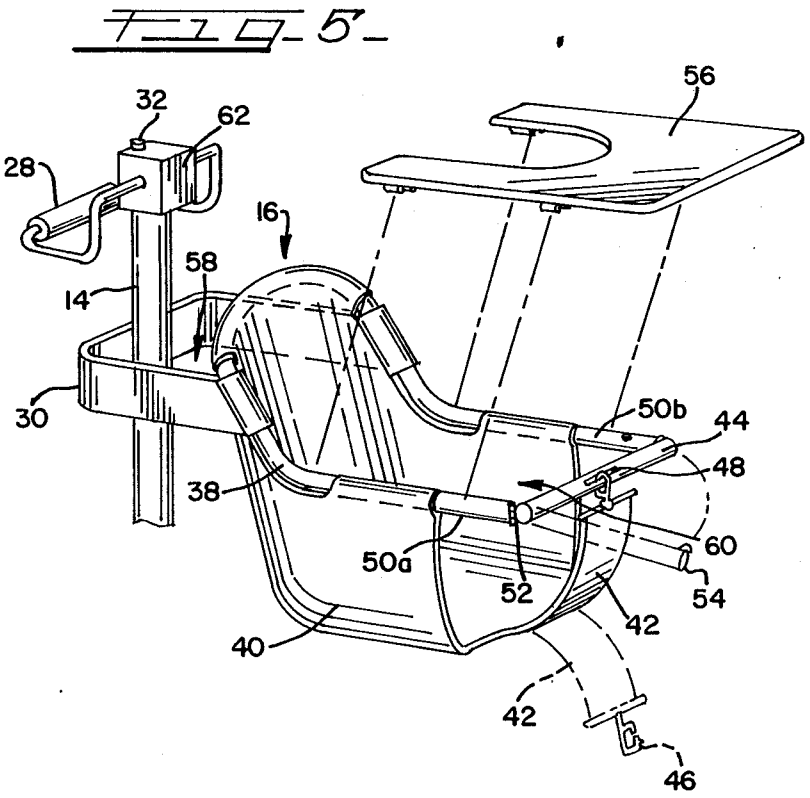
FIG. 5 is a exploded perspective view of the preferred embodiment showing the U-shaped seat frame, seat construction and a removable tray.

In FIG. 5, the chair 16 is comprised of a bent U-shaped seat frame 38, a seat sling 40 of pliable material, such as fabric, which is formed into seat that hangs from the seat frame 38, and a retaining bar 44. The seat frame 38 has an opening 60 facing in the same direction as the base opening 24 and the opening 58 of the cantilevered beam 30. The seat frame 38 is attached to the ends of beam 30.

The seat sling 40 has a strap 42 formed by a contiguous piece of the seat sling 40 located at the front edge of the seat. The strap 42 is intended to extend between the user's legs when in a seated or standing position as shown in FIGS. 1 and 3. At the end of strap 42 is clasp 46 which attaches to slot 48 of the retaining bar 44. The retaining bar 44 is hingeably attached at 52 to one of the arms 50*a*,50*b* of the seat frame 38. The unhinged end 54 of retaining bar 44 is securable to the unhinged arm 50*a*,50*b* of the seat frame 38. The retaining bar 44 has slot 48 which receives clasp 46 and restrains the user 18 in the device 10.

The arms 50*a*,50*b* are extend beyond the front seat edge and capable of receiving a tray 56 such as that shown in FIGS. 4 and 5. Tray 56 can be used for various purposes such as eating, working or any other activity requiring a flat surface and may be detachable from the arms 50*a*,50*b* of the seat frame 38 when not in use.

The relationship of the strap 42 to the arms 50*a*, 50*b* and retaining bar 44 defines two openings for the user's legs. The length of the arms 50*a*, 50*b* as they extend beyond the front seat edge increases the size of the leg openings and enhances the leg movement of the user.

While the invention has been described with reference to a preferred embodiment, it will be understood by those skilled in the art that various changes may be made and equivalents may be substituted for elements thereof without departing from the broader aspects of the invention. For instance, the seat may be connected to the height adjustable standard in various ways. While the present invention provides for hydraulic height adjustment, the height of the seat may be adjustable by other means. Likewise, the handle and foot pedal pumps, the valve and the driven movement of the hydraulic system may be placed at various locations on the present invention. Additionally, the present invention may be provided with other vertical and/or horizontal supports which do not interfere with the leg movement of the user during walking. Also, it is intended that broad claims not specifying details of a particular embodiment disclosed herein as the best mode contemplated for carrying out the invention should not be limited to such details.

We claim:

1. A wheelchair-walker device for use by a user requiring assistance in walking or moving about, said device being intended to receive and support the user alternatively in sitting and standing positions and facilitating movement by the user in desirable, erect anatomical positions, said device being adjustable for the proportions and desired position of the user, and device comprising:

a base having an opening adapted to facilitate the user's entry to and exit from the device and having wheels to provide for mobility of said device;

a standard connected to said base opposite said opening;

a seat frame having a U-shape, said frame being secured to said standard and having an opening facing away from said standard and aligned with said opening in said base;

a seat suspended from said seat frame and adapted to receive said user, said seat having a front seat edge opposite said standard;

arms projecting from said seat frame and each of said arms having a portion extending beyond said front seat edge defining a handle;

a retaining bar adapted to restrain the user in the device, said restraining bar being attachable to said handles to close said seat frame opening;

a strap extending between said front seat edge and said retaining bar, said strap adapted to extend between the legs of the user; and, lift means for adjusting the height of the seat frame to accommodate the user in seated and standing positions.

2. The wheelchair-walker of claim 1 wherein the base has footrests adaptable to receive the feet of the user in a seated position.

3. The wheelchair-walker of claim 1 wherein the standard includes a handle for effecting height adjustment of said seat frame through said lift means and to facilitate movement of the device by an assisting person, said handle being located on the standard.

4. The wheelchair-walker of claim 1 wherein the base has a foot control to adjust the height of said seat frame.

5. The wheelchair-walker of claim 1 wherein the standard has a hand control to adjust the height of said seat frame.

6. The wheelchair-walker of claim 1 wherein the seat frame has a bent U-shape.

7. The wheelchair-walker of claim 1 wherein the seat frame has two parallel horizontal arms capable of receiving a tray.

8. The wheelchair-walker of claim 1 wherein the lift means includes a hydraulic lift having a driven part located in said standard, at least one pump and a valve to control the desired height of said seat frame.

9. The wheelchair-walker of claim 8 wherein said pump is located on the base, said pump being operable by the user.

10. The wheelchair-walker of claim 8 wherein said pump is located on said standard, said pump being operable by an assisting person.

11. The wheelchair-walker of claim 1 wherein said retaining bar hingeably attaches to the seat frame.

12. The wheelchair-walker device of claim 1 wherein said seat is made of flexible material.

13. A wheelchair walker device for use by a user requiring assistance in walking or moving about, said device intended to provide for foot propulsion by the user in a seated or standing position, said device comprising:

a base having wheels to provide for the mobility of said device, said base having an opening for accommodating the user's entry and having footrests for placement of the user's feet;

a standard that is perpendicularly connected to said base and located opposite of said base opening, said standard being hydraulically operated to provide a portion moveable between a lower seated position and an upper walking position, said standard having a driven part;

a handle pump attached to said standard and acting as a pump for said hydraulic operation and as a handle to push said device;

a foot pedal pump located on said base and acting as a second pump for said hydraulic operation said foot pedal pump having the capacity of being deactivated;

a hose connecting said foot pedal pump to the hydraulic operation contained in the standard;

a valve located between said driven movement and said handle and foot pedal pumps, said valve being adjustable so as to regulate the pressure of the hydraulic operation and maintain the desired height;

a beam horizontally cantilevered from said standard said beam having a U-shape and forming an opening in the same direction as said base opening;

a seat frame having a bent U-shape, said seat frame being attached to said beam;

a seat sling of flexible material hanging from said seat frame, said seat sling forming a seat adapted to receive said user and having a front seat edge opposite said standard;

two parallel horizontal arms attached to said seat frame, each said arms having a portion extending beyond said front seat edge and defining a handle, said arms being able to receive a removable tray and forming an opening above said base opening for entry and exit by the person;

a retaining bar disposed between said handles and adapted to restrain said user in a seated or standing position, said bar being hingeably attached to one of said handles; and, a strap being a contiguous part of said seat sling and adapted to extend between the legs of the user, said strap extending from the bottom front side of said seat sling and being attachable to said retaining bar to prevent the user from slipping out of the device.

* * * * *

UNITED STATES PATENT AND TRADEMARK OFFICE

CERTIFICATE OF CORRECTION

PATENT NO. : 4,890,853

DATED : January 2, 1990

INVENTOR(S) : Luanne Olson

It is certified that error appears in the above-identified patent and that said Letters Patent is hereby corrected as shown below:

Column 6, lines 42 and 43 should read: --The arms 50a, 50b extend beyond the front seat edge and are capable of receiving a tray 56 such as that--.

Column 7, line 12 should read: --portions and desired position of the user, said device--.

Signed and Sealed this

Fifteenth Day of January, 1991

*Attest:*

HARRY F. MANBECK, JR.

*Attesting Officer*

*Commissioner of Patents and Trademarks*